US005262697A

United States Patent [19]

Meury

[11] Patent Number: 5,262,697

[45] Date of Patent: Nov. 16, 1993

[54] PIEZOELECTRIC MECHANISM FOR GAS LIGHTERS

[75] Inventor: Marcel Meury, Tarragona, Spain

[73] Assignee: LaForest Bic, S.A., Tarragona, Spain

[21] Appl. No.: 849,245

[22] Filed: Mar. 11, 1992

[30] Foreign Application Priority Data

Mar. 13, 1991 [ES] Spain ..... 9100652
Jul. 23, 1991 [ES] Spain ..... 9101719

[51] Int. Cl.[5] ..... H01L 41/08
[52] U.S. Cl. ..... 310/339; 361/260
[58] Field of Search ..... 310/338, 339; 361/260; 431/255

[56] References Cited

U.S. PATENT DOCUMENTS

| | | | |
|---|---|---|---|
| 3,486,075 | 12/1969 | Steinke et al. | 310/339 X |
| 3,521,987 | 7/1970 | Goto | 310/339 X |
| 3,729,639 | 4/1973 | Heinouchi et al. | 310/339 |
| 3,829,737 | 8/1974 | Johnsson | 310/339 X |
| 3,866,069 | 2/1975 | Ishii et al. | 310/339 |
| 3,949,248 | 4/1976 | Duffner et al. | 310/339 |

*Primary Examiner*—Mark O. Budd
*Attorney, Agent, or Firm*—Pennie & Edmonds

[57] ABSTRACT

This mechanism of the invention has two telescopic assemblies (1, 2) aided by a spring (20) for maintaining a maximum extension position between the assemblies. The interior assembly (1) includes a piezoelectric element (3) which is immobilized between an anvil (4) and a limiting piece (5) over which a plexor (6) hits to generate the lighting spark. The external telescopic assembly (2) is prevented from rotation relative to the internal one (1) by an angular piece (22) having orthogonal flanks. One flank of this angular piece has a central slot forming two lugs (24), which enter respective parallel notches (23) of the internal telescopic assembly (1) when crossing its wall. The other flank contacts one of the external faces of the other telescopic assembly. The spring (20) is external and is axially distant from the piezoelectric element (3). Another spring (14), for aiding the plexor (6), is totally guided in the interior of the telescopic assembly (1) and remains, in turn, included in the circular void of the closing cap (15) of the external telescopic assembly (2). The closing cap (15) is axially displaceable with respect to the assembly (2), with the windows (17) therein having a greater length for connection of the cap, and being provided with teeth (11).

20 Claims, 8 Drawing Sheets

PIEZOELECTRIC MECHANISM FOR GAS LIGHTERS

BACKGROUND OF THE INVENTION

1. Technical Field

The present invention relates to a piezoelectric mechanism for gas lighters which includes a number of advantages compared to those currently used in the art.

2. Background Art

As is known, all piezoelectric mechanisms are basically formed by a pair of telescopic assemblies that are mutually aided by a spring which maintains them in a position of maximum extension. Such mechanisms include means that limit the movement of the assemblies to prevent accidental separation. Solidly fixed to one of these assemblies, indistinctly, is a crystal or piezoelectric element which provides a lighting spark when impacted by a plexor. The piezoelectric element, in turn, is placed between a metallic piece, called an "anvil", and another piece which actually receives the impact of the plexor, called a "base" or "limiting piece".

The plexor functions in the axial void of the internal telescopic body and, in a rest position, is distant from the piezoelectric element due to the presence of a retaining mechanism. When a manual compressive force is applied over the telescopic set, ignition is produced by reducing the action of the spring which acts on the telescopic set, while simultaneously compressing a second spring that afterwards impulses the plexor in the moment of triggering, thus creating the impact energy of the plexor against the base to generate the spark. The plexor is guided by a pair of facing longitudinal slots which crosses the wall of one of the tubular assemblies, each one of them carrying the dimetient lugs of the plexor.

The plexor is retained at rest by its transversal lugs, each one of which is positioned in open lugs at one side of the longitudinal slot with respect to said tubular assembly. These lugs are introduced into the open lugs when the plexor is rotated. For the plexor to make a small rotation, both lugs must leave the retaining notches and re-enter them after impact so that the repositioning of the mechanism takes place. At the end of the compression run of the telescopic set and during its distension, respectively, the dimetient lugs of the plexor are pressed by the edges in ramp of windows each one provided in the other telescopic body, where these lugs also function.

Currently, although the external shape of the telescopic set is quadrangular and the entire mechanism is located in a housing prepared for such a purpose in the lighter assembly, both components must not have relative rotation. In some cases, this problem is resolved by making the internal section of the external assembly and the external shape of the internal assembly different, thus enabling the introduction of a plexor carrying dimetient lugs. These lugs are placed in a rotated position, in the existing windows in the other telescopic assembly. However, this asymmetrical form of the set is difficult to mold.

In other cases, these sections are made circular. This implies that the dimetient lugs of the plexor are materialized by a gudgeon that has to be assembled after the introduction of the plexor and simultaneously to the compression performed on the telescopic set. The assembly of this gudgeon considerably increases production costs of the piece and those of assembly of the mechanism.

Spanish patent P-8902741 discloses a piezoelectric mechanism for gas lighters in which the aforementioned problems referred to were resolved, or at least were favorably reduced, both in the economic aspect and in the functional and structural ones. In this patent, it is possible to do without the angular displacement relative to both telescopic components, by anticipating in the external assembly a pair of lugs that perform with the function of a linch pin. These lugs operate in the interior of the same slots provided in the internal telescopic assembly for axial displacement of the plexor, such that these slots need to have a greater length than is necessary only for the guidance of the plexor. Shortening of the run is obtained for the electric current, since it only circulates through the anvil, piezoelectric element, the plexor limiting piece and the external telescopic assembly. This is different than other previous mechanisms in which the electric current also passes through the springs that aid the plexor and the telescopic set. This run is short and the electric current used to generate the spark passes from the plexor limiting piece or the lower seating of the piezoelectric element to the external telescopic assembly linch pins. There exists a small play in the contact surfaces of these elements that can cause failures in ignition or can result in current derivations through another run somewhat longer. This is especially true when the seating of the plexor on the limiting piece and the seating of the limiting piece on the internal face of the piezoelectric element is not in perfect alignment.

In all cases, the spring aiding the plexor is partially or totally guided within the interior of the telescopic assembly that houses the plexor. Establishing support in its other extreme is a cap that is fixed to the free end of the assembly. This cap is provided with lugs with sawtooth sections, which are introduced in respective lateral windows in facing walls of the telescopic assembly and are being immobilized in this fixed position.

It has been found that all prior piezoelectric mechanisms, that is, those having a telescopic set with its adjacent elements, have slight gaps in its housing in the lighter assembly, mainly in an axial sense, which provokes an undesired movement of the pulser.

In addition, the gap or internal base of the telescopic set is directly rested on a stud that emerges from the bottom of the assembly housing, a known way this presents its extreme top in a conical form, which is then introduced into a small hole or impression which is provided as a seating to contribute to the lateral immobilization of the piezoelectric mechanism, and to endow to the set a certain rigidity which determines the accumulation of gaps. Thus, a small movement of the piezoelectric mechanism is noted on pulsing, and even this does not recover to its position of rest efficiently. In trying to solve this problem, an additional spring is mounted, placed between the bottom of the housing for the piezoelectric element and the lower cap of the latter. This complicates the device and makes it more expensive to manufacture. The spring is necessary, however, to open and recover gas during the rocking of the forked ring during functioning of the gas burner of the lighter.

SUMMARY OF THE INVENTION

It is thus an object of the invention to obtain a perfect guidance of both telescopic assemblies, which have a totally symmetrical geometry for easy construction. This guidance means is external to the position of maximum separation of the recovery spring of the telescopic set, as well as to the spring impulsing the plexor, which is totally guided in its run.

It is also an object of the invention to eliminate the induction effects created during spark generation, by anticipating that the external spring occupies an axially distant position from the piezoelectric element.

It is another object of the invention to shorten the run of the electric circuit, the least number possible of elements intervening by using non-conducting plastic to lower production costs, as well as that prior to the moment of producing the gas ignition spark, a perfect mixture of the latter with air is achieved to optimize combustion.

Lastly, the assurance of a perfect seating for the plexor over the piezoelectric element by means of the limiting piece or percussion base, achieves a spark of greater intensity and duration.

Another objective is the improvment of the functional behavior of the lighter, by completely eliminating the possible axial play existing in the piezoelectric mechanism due to the possible accumulation of gaps in the assembly of the different components, as well as between the same piezoelectric mechanism and the lighter housing. This improvement is achieved without the necessity of adding an additional spring as in the prior art.

These improvements are achieved in a piezoelectric mechanism for a gas lighter that has first and second telescopic assemblies; a first spring for maintaining the telescopic assemblies spaced apart by a predetermined distance; a piezoelectric element fixedly mounted in one of the telescopic assemblies; a plexor element movably disposed in the other of the telescopic assemblies and retained in a first position at a spaced distance from the piezoelectric element; a second spring for biasing the plexor element toward the piezoelectric element; means for preventing relative rotation between the telescopic assemblies; and means for releasing the plexor element from its first position.

The releasing means is separately associated with the telescopic assemblies such that the application of a compressive force of sufficient magnitude to cause the first and second assemblies to move toward each other also causes the releasing means to release the plexor element from its first position, so that the second spring can move the plexor element toward the piezoelectric element with sufficient force to generate a spark. Thus, the mechanism includes means for transmitting the spark to the location where gas is released from the lighter for ignition thereof.

The first telescopic assembly contains the piezoelectric element mounted between an anvil and a limiting piece which is contacted by the plexor element to generate the spark, while the second telescopic element includes a pair of elongated notches and slots which guide the movement of the plexor element therein. The plexor element has a generally cylindrical body, a tapered front end, a cylindrical stud for engaging the second spring, and a pair of diametrically opposed lugs mounted on the cylindrical body for engaging the notches and slots of the second telescopic assembly.

The mechanism releasing means comprises a first ramp located in each of the elongated notches such that the movement of the telescopic assemblies toward each other causes the plexor element lugs to contact the ramps of the elongated notches, thus rotating the plexor element out of its first position. These elongated notches may also include slots for engaging the plexor element lugs for retaining the plexor element in the first position. Preferably, each of the elongated notches includes a second ramp for directing the plexor element lugs into the respective slots and the first position when the compressive force is removed and the telescopic assemblies return to their spaced apart predetermined distance.

The telescopic assemblies rotation prevention means includes an L-shaped angular piece with a first portion engaging one of telescopic assembly and a second portion engaging the other telescopic assembly. Advantageously, the first telescopic assembly includes an external notch and the first portion of the L-shaped angular piece includes a pair of lugs forming a central slot for engaging the external notch of the first telescopic assembly. The central slot can include means for lockingly engaging the first telescopic assembly to prevent extraction of the L-shaped angular member therefrom. In addition, at least a portion of the second telescopic assembly has a square cross-sectional configuration, and the second portion of the L-shaped angular piece includes an orthographic flank for engaging one of the sides of the second telescopic assembly. Thus, the end of the orthographic flank of the second portion of the L-shaped angular piece should include a ramp whose inclination regulates the opening of the gas on being displaced angularly with respect to the forked ring of the burner.

The mechanism may also include a cap member interlockingly engageable with an end of the second telescopic assembly for engaging the second spring and retaining it therein, and means for providing axial displacement between the second telescopic assembly and the cap member, with the second spring member maintaining the cap member at a predetermined distance from the second telescopic assembly. The axial displacement means comprises a pair of tab members on the cap member and a pair of windows located in the second telescopic assembly.

Preferably, each of the anvil, piezoelectric element, limiting piece and L-shaped angular piece is formed of a conductive material or conductive metal so that an electric current can pass through these components to the forked ring and burner to ignite the gas.

BRIEF DESCRIPTION OF THE DRAWINGS

To facilitate the understanding of the characteristics of the invention, the following drawings figures have been provided, wherein.

DESCRIPTION OF THE PREFERRED EMBODIMENTS

Figure 1:
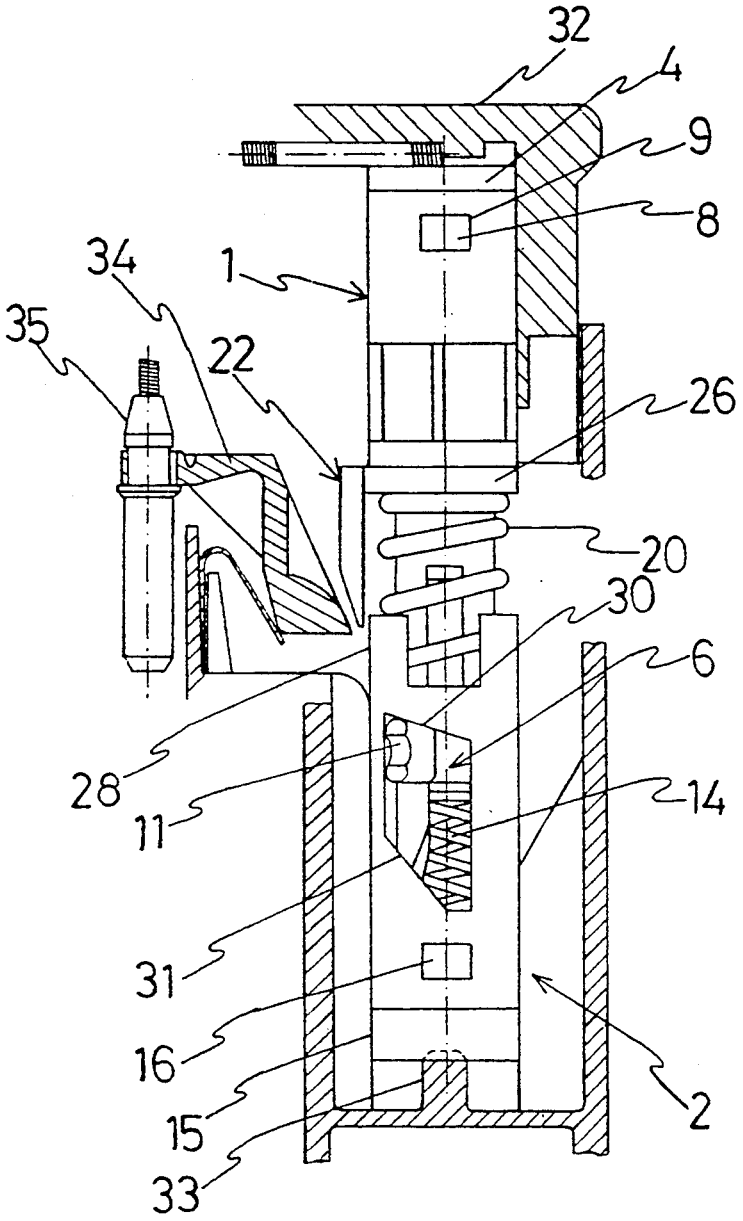
FIG. 1: is a front longitudinal view, in cross section, of the piezoelectric mechanism of the invention, in an assembled position and located in a gas lighter assembly.

To solve the disadvantages previously referred to and to obtain the superior characteristics proposed, the piezoelectric mechanism for gas lighters the invention requires a pair of telescopic assemblies of circular section, which lack relative rotation by means of an external angular piece that has one of its flanks fixed to the internal telescopic assembly while the other flank is placed tangentially through the exterior of one of the faces of the external telescopic assembly. One of the flanks of the angular piece has a central longitudinal slot through which the internal telescopic assembly is transversely introduced. The flank is provided with two diametrically opposed parallel notches, so that the angular piece can establish contact with the limiting piece of the plexor which occupies an intermediate position between the limiting piece and the crystal or piezoelectric element.

One end of the recovery spring, at its maximum distance from the telescopic set, or at mechanism rest, externally surrounds the internal telescopic assembly and establishes support on the angular piece. The other end of the spring frontally impulses the external telescopic assembly.

With this device, the external spring is always in an axially distant position from the piezoelectric element, such that the latter remains situated beyond the limiting piece to confront the angular piece of the spring seating.

The spring aiding the plexor is perfectly guided in the cylindrical axial void of the internal telescopic assembly and, when producing the impact of the plexor, it remains totally housed within the interior of the assembly.

The electric current makes a short run since it passes directly and with a good contact from the base of the firing pin or limiting piece of the same, to the metallic angular piece. Thus, the external telescopic assembly does not need to be of a conductive plastic material and its construction can be more economical.

The free flank of the angular piece is topped in a ramp having an inclination which regulates the opening of gas during the entire withdrawal run of the telescopic set when it acts over the lighter pulser. Spark generation occurs in the same moment of the mentioned run.

Another characteristic of the mechanism is that the functional behavior of the lighter is improved by completely eliminating the possible axial play in the piezoelectric mechanism due to the accumulation of gaps in the assembly of the different components, as well as between the mechanism and the lighter assembly. This occurs because the third additional spring which is usually placed between the bottom of the lighter assembly housing and the cap of the lower telescopic assembly of the piezoelectric mechanism can be eliminated.

According to the present invention, the closing cap at the free end of the telescopic assembly is housed in the interior assembly of the lighter and is precisely that which closes the assembly of greater section of the telescopic set, with the spring aiding the plexor establishing support over it. The closing cap is axially mobile with respect to the closing assembly because the fixing windows of the lugs in saw teeth of the lower cap, are torn to permit this play. In the mechanism rest position the lower gap remains in the more distant position with respect to the mouth of the lower telescopic assembly, due to the existence of the spring aiding the firing pin. This is the most distended position of the assembly, and it produces an increase of spring life, since the spring does not need to be mounted under tension.

With this device, the piezoelectric mechanism remains mounted in the rest position with total recovery of the pulser, due to the special assembly of this spring. On performing pulsing to generate ignition, firstly this spring is compressed until the cap remains in the introduction position, compression of the external spring continues to assist the movement of the telescopic set, while simultaneously to this movement, compression of the spring aiding the plexor takes place to impact against the piezoelectric crystal and finish this compression run of the telescopic sets.

Figure 2:
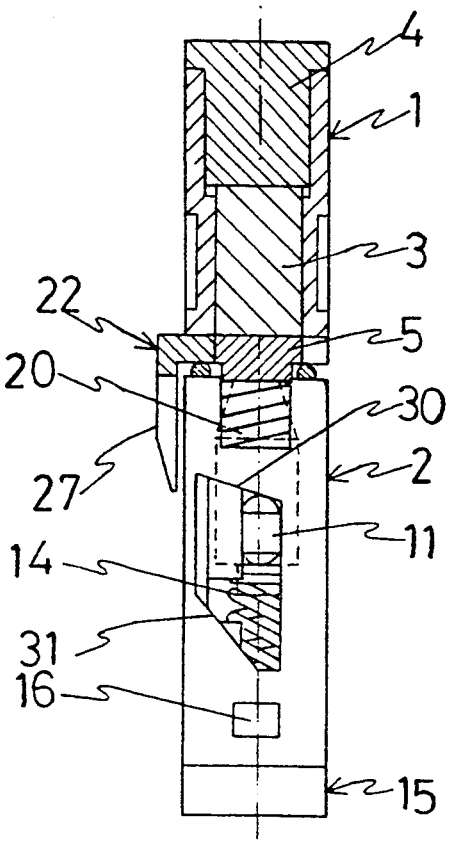
FIG. 2 is a front view of the mechanism of FIG. 1 in the triggering position and without showing the lighter assembly.
Figure 3:
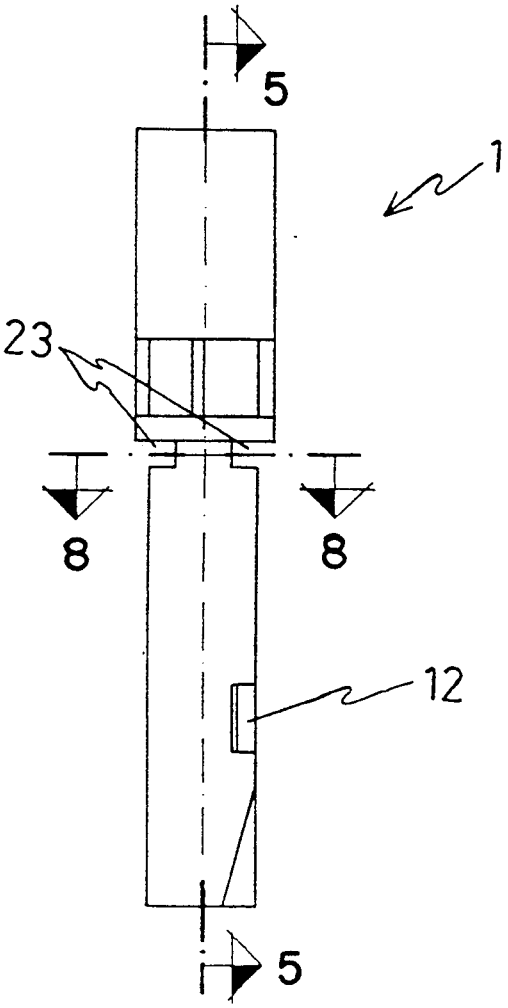
FIG. 3 is a front view of the internal telescopic assembly of the mechanism of FIG. 1.
Figure 5:
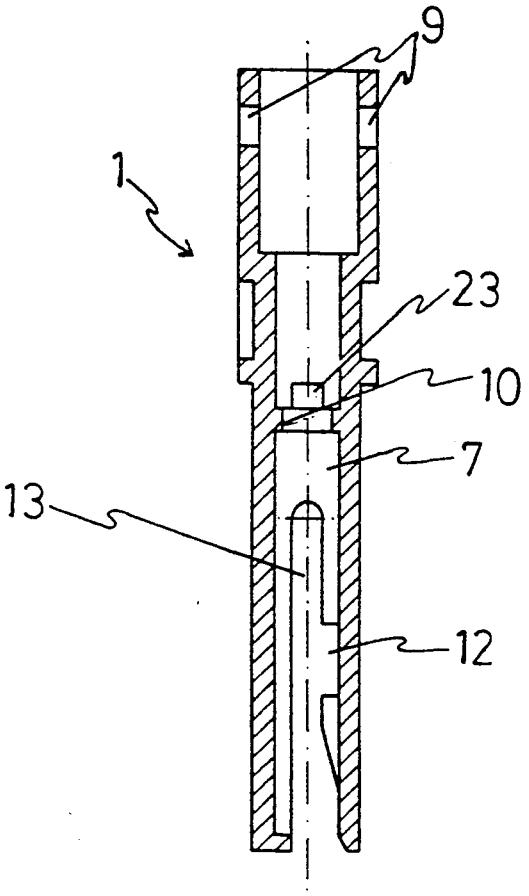
FIG. 5 is a side view in cross section along the cut line E—E of FIG. 3.
Figure 6:
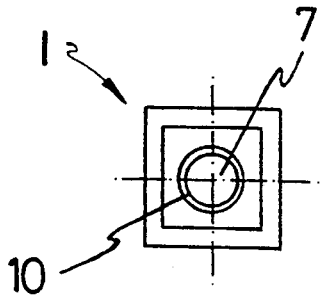
FIG. 6 is a top view of the assembly of FIG. 4.
Figure 7:
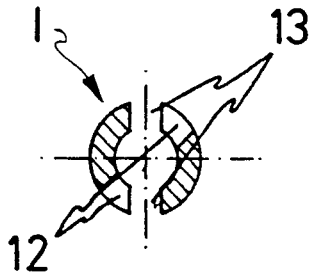
FIG. 7 is a cross sectional view taken along cut line D—D of FIG. 4.
Figure 8:
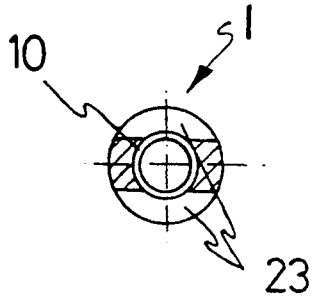
FIG. 8 is a cross sectional view taken along cut line A—A of FIG. 3.
Figure 9:
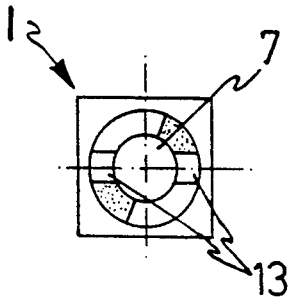
FIG. 9 is a bottom view of the assembly of FIG. 4.
Figure 10:
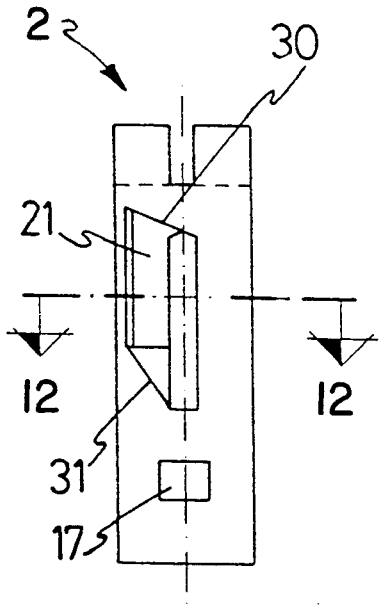
FIG. 10 is a front view of the external telescopic assembly of the mechanism of FIG. 1.
Figure 11:
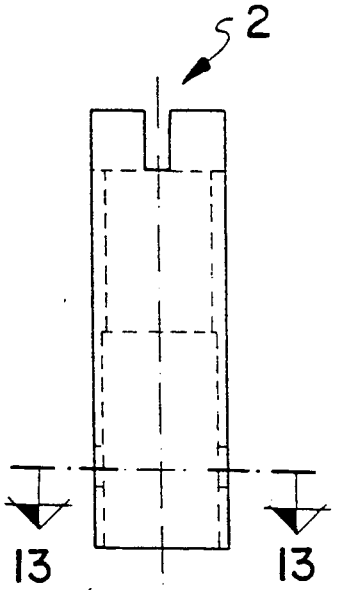
FIG. 11 is a side view of the assembly of FIG. 10.
Figure 12:
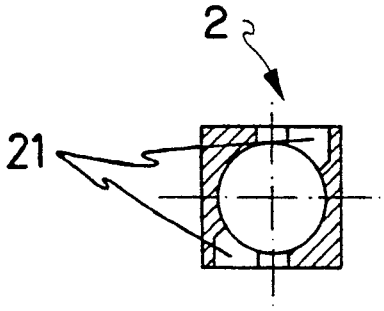
FIG. 12 is a cross sectional view taken along cut line C—C of FIG. 10.
Figure 13:
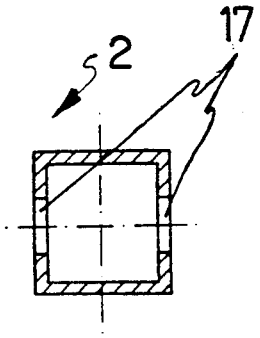
FIG. 13 is a cross sectional view taken along cut line B—B of FIG. 11.
Figure 14:
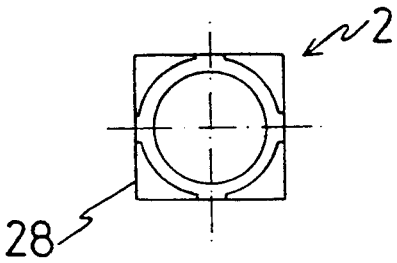
FIG. 14 is a top view of the assembly of FIG. 11.

Referring now to the numeration indicated in the drawing figures, the piezoelectric mechanism for gas lighters proposed by the invention has two telescopic assemblies: the internal assembly 1 and the exterior assembly 2. FIG. 1 illustrates the mechanism at rest, while FIG. 2 shows the position that the piezoelectric element 3 occupies in the interior of the telescopic assembly 1 when engaged. The element is immobilized between an anvil 4 and a limiting piece or base 5 over which the plexor 6 hits and is displaced. FIG. 5 shows that the plexor 6 is guided in an interior cylindrical axial void 7 of the telescopic assembly.

The anvil 4 adjustably enters the entire quadrangular section of the upper part of assembly 1. Anvil 4 includes a pair of lugs 8 on two opposed faces to provide immobilization of the anvil 4 by engaging corresponding windows 9 in assembly 1 (see FIGS. 4 to 8). The limiting piece 5, in turn, over which the plexor 6 hits, has a staged cylindrical form with an upper half of greater diameter than the lower one. This upper cylindrical portion is supported by a ring ledge 10 positioned in the cylindrical void of the internal assembly 1 (FIG. 5), with the cylindrical portion of lesser diameter of the limiting piece 5 extending beyond this ledge 10.

Figure 4:
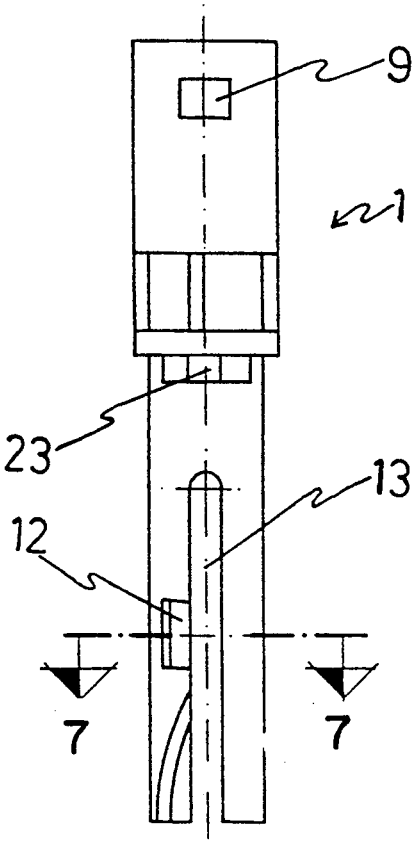
FIG. 4 is a side view of the assembly of FIG. 3.
Figure 15:
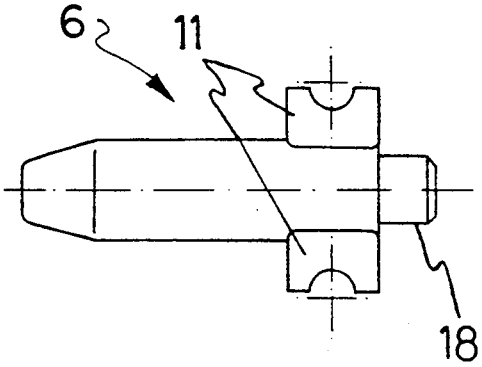
FIGS. 15 and 16 are front and side views of the plexor element.
Figure 16:
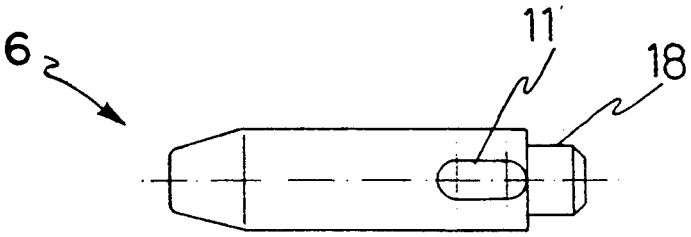

The plexor 6, whose geometry can be clearly seen in FIGS. 15 and 16, is of a staged cylindrical section and includes two diametrically opposed lugs 11 in its zone of greater diameter, while the other end has a conical shape. The dimetient lugs 11 enable the position of the plexor 6 at the appropriate distance with respect to the piezoelectric element 3. Thus by moving the lugs, the plexor can impact over the crystal 3, through the limiting piece 5, to produce the ignition spark. Lugs 11 are supported by and in lateral notches 12, which are opened towards the same side in the direction of rotation, from one of the laterals of the longitudinal slots 13, and are provided in the cylindrical portion of the internal assembly 1 and in dimetient opposition (FIGS. 4 and 5). The transverse lugs 11 function diametrically opposed to the plexor 6. Thus, the plexor 6 is displaced linearly, and without rotation, along slots 13 and only has to rotate to enter in the lateral notches 12, the same as to leave them.

Figure 17:
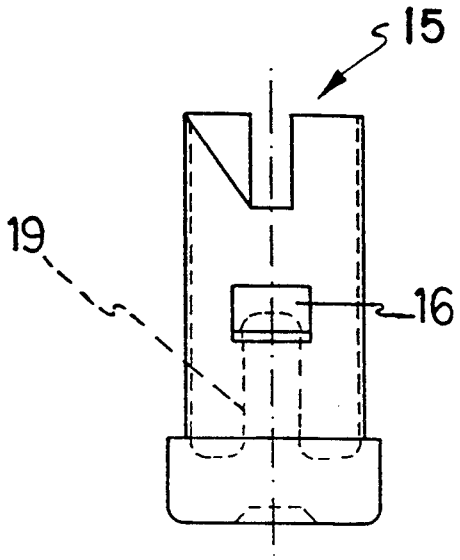
FIGS. 17, 18 and 19 are respective front, side and top views of a cap for the external telescopic assembly.
Figure 19:
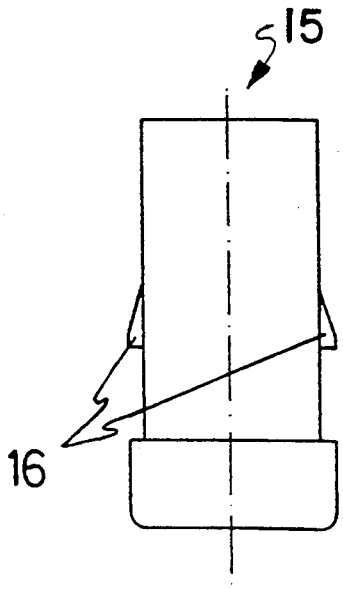
Figure 18:
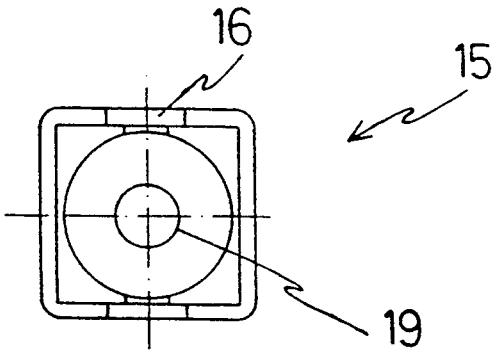

The plexor 6 is aided by a spring 14 that engages on the bottom of the cap 15 which closes the free end of the external telescopic assembly 2. The cap 15 is secured to the external telescopic assembly 2 by toothed lugs 16 of cap 15 which cooperate with complementary windows 17 of assembly 2. The ends of the spring 14 engages cylindrical stud 18 of the plexor 6 and coaxial spigot 19 of the cap 15, as shown in FIGS. 17 to 19.

The internal 1 and external 2 telescopic assemblies are aided by an external spring 20 (FIGS. 1 and 2) which biases them towards a position of maximum extension of the set. This position is limited by a ceiling that is defined by the dimetient lugs 11 of the plexor 6 that are retained in the edges of respective windows 21, existing in the external telescopic assembly 2.

Figure 20:
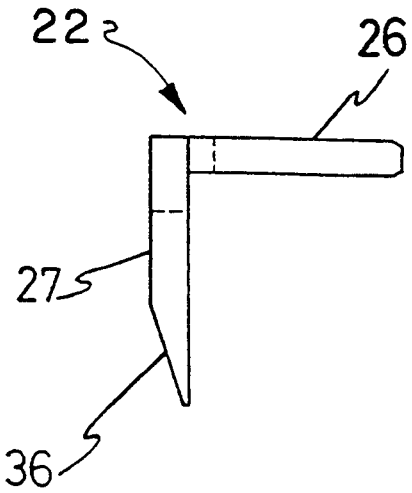
FIGS. 20, 21 and 22 are respective front, side and top views of the external angular piece which prevents relative rotation between both bodies of the telescopic set.
Figure 22:
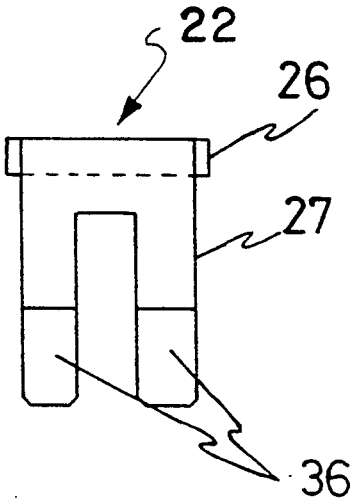
Figure 21:
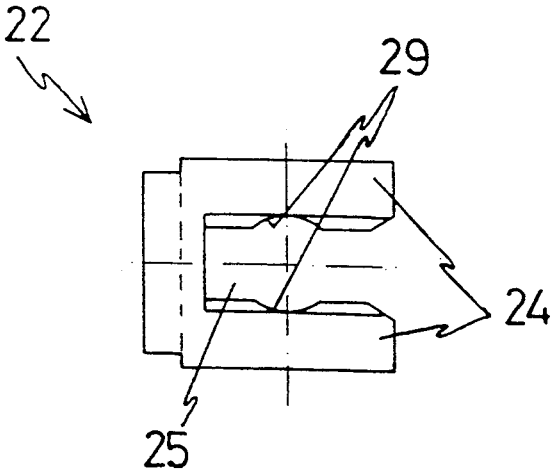

The telescopic assemblies 1 and 2 are prevented from relative rotation by means of an external element defined by the angular piece 22, whose external geometry is shown in FIGS. 20 to 22. This piece 22 has the shape of an "L" and has one of its flanks 26 fixed to the internal telescopic assembly 1 through two parallel and diametrically opposed notches 23, in which the internal edges of respective lugs 24 of this angular piece 23 are housed. These lugs 24 form a central slot 25. The other orthographic flank 27 remains in a situation parallel to the longitudinal axes of the mechanism and in such a way that its extreme edge is slightly overlapped with respect to one of the external telescopic assembly faces 2, as shown by 28 in FIG. 1. This prevents relative rotation between these elements, since when these elements are brought together to generate the ignition spark, the overlapped zone is much greater, as shown in FIG. 2.

The spring 20 directly engages the end of flank 26 because it is precisely situated at the height where the extreme greater diameter of the limiting piece 5 remains, as shown in FIG. 2. Therefore, the limiting piece 5 is situated between the lugs 24 and more specifically between the necking shoulders 29 in its chamfered edges. These necking shoulders 29 have the same circumference as the widened part of the limiting piece 5. This construction only allows the correct position of the angular piece 22 to be reached when the limiting piece 5 has not yet been introduced. After assembly of the limiting piece 5 into the assembly, the angular piece 22 can no longer be extracted, since the limiting piece 5, the piezoelectric element 3 and the anvil 4 form a compact, immobile unit.

In the mechanism rest situation (shown in FIG. 1), the plexor 6 has its dimetient lugs 11 housed in the respective lateral notches 12 of the longitudinal slots 13 of the internal assembly 1. This position is maintained due to the slight pressure that the spring 14 applies to the plexor 6, thus maintaining the lugs 11 against the more internal transverse edge of window 21 of the external assembly 2. These transverse edges of the window are oblique to form a ramp 30. The external spring 20 is therefore distended or at rest.

To enable the plexor 6 to impact against the limiting piece 5, it is necessary to withdraw or encompass the telescopic set by applying a compressive force. During the trajectory of withdrawal, the compression of both springs 14 and 20 takes place. With this displacement, the dimetient lugs 11 of the plexor 6 move along the edges of ramp 30 of the respective windows 21. When lugs 11 contact the opposite edge 31 of the window 21, which is also oblique to form a ramp, the plexor 6 rotates such that its dimetient lugs 11 come out of the slots 12, and continue slipping at high speed along the longitudinal slots 13 of the interior assembly 1 producing the impact with the base 5. Under these conditions, the compression of the spring 20 is still maintained, as shown in FIG. 2.

When the compressive force that the user is applying over the pulser 32 (FIG. 1) ceases, the telescopic assemblies 1 and 2 are extended due to the action of the compressed external spring 20. During this movement, the dimetient lugs 11 of the plexor 6 are displaced along the respective slots 13 of the interior assembly 1 until they reach the respective lateral notches 12. When the lugs 11 are introduced into lateral notches 12, they move along the edges of ramp 30 of the Windows 21 of the external assembly 2, until the limiting extension position of the telescopic set is reached.

The functioning of the mechanism is as follows. When a pressure is applied on a pulser 32, the telescopic set is compressed or withdrawn, since its lower end leans on the ledge 33 of the housing bottom. During this movement, the external flank 27 of the angular piece 22 progressively pushes a forked ring 34 that acts to cover the mouth 35 of the burner to allow the escape of gas and its intimate mixture with air. The spark is then produced during the last moment of this compression run to ignite the gas/air mixture. The flank 27 therefore defines a cam whose finishing ramp 36 materializes a regulation inclination of the gas opening by displacing the forked ring 34 initially and in an angular way and maintaining it afterwards in this situation to allow gas to flow.

The angular piece 22, besides constituting the anti-rotational means of the telescopic set and acting as a cam which allows the exit of gas, defines the current transmission element in the electrical circuit on producing the ignition spark. The electrical current uses a short run on closing the circuit with the following pieces: anvil 4, piezoelectric element 3, base piece 5 of the firing pin and angular piece 22, then passing from this to the conducting forked ring 34 and the burner mouth 35. A perfect electrical transmission in the angular piece 28 seating is assured with respect to the limiting piece 5 since in every moment an adjusted contact as has been explained above is being established.

With this structure and functionality of the piezoelectric mechanism, the external assembly 2 and of course its bottom cap 15, do not need to be made of electrically conductive plastic, since current does not pass through them but is diverted by the angular piece 22.

Due to the fact that the piezoelectric element 3 or crystal is axially distant from the external spring 20, induction effects are not produced, which improves spark intensity and duration, as well as voltage.

The limiting piece 5, or firing pin base, is manufactured of a malleable alloy that enables a perfect seating over the crystal or piezoelectric element 3, which is improved over time. This same material is used in the construction of the anvil 4 and the angular piece 22. The latter does not need to be cylindrical as is the axial void of the cap 15, which collaborates even more in guiding the telescopic set and the movement of the springs.

As shown in FIG. 1, the entire piezoelectric mechanism may be introduced in the lighter assembly, in a housing provided for the purpose and in such a way that the cap 15 for closing the telescopic assembly 2 remains seated on the stud 33 that emerges from the wall of the bottom of the lighter assembly.

To further improve the functioning of the lighter, the present invention proposes to eliminate gaps in the piezoelectric mechanism due to manufacturing tolerances or use. It is for this reason that the cap 15 has been provided to close the external telescopic assembly 2. This cap can be axially displaced with respect to the assembly 2, being able to approach and distance itself from it, against or in favor, respectively, of the helicoidal spring 14 that aids the plexor 6, this displacement being limited by ceilings.

In these conditions, the helicoidal spring 14 aids the plexor 6 to maintain its most distant position from elements 2 and 15. Cap 15 is retained by means of the teeth 16 that establish support on the lowest edges of the respective windows 17 of assembly 2. In this position the spring 14 is in its rest position. which lengthens its life as it is only compressed when its use is required to generate the ignition spark, or acting over the pulser 32 of the lighter.

Figure 23:
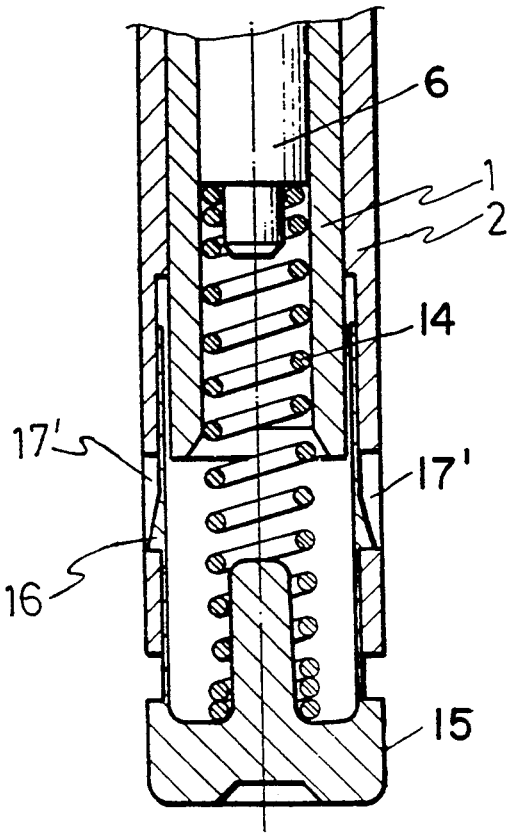
FIG. 23 is a cross sectional view of a piezoelectric mechanism which includes a telescopic connection of the closing cap of the external telescopic assembly, with the mechanism being in the rest position.
Figure 24:
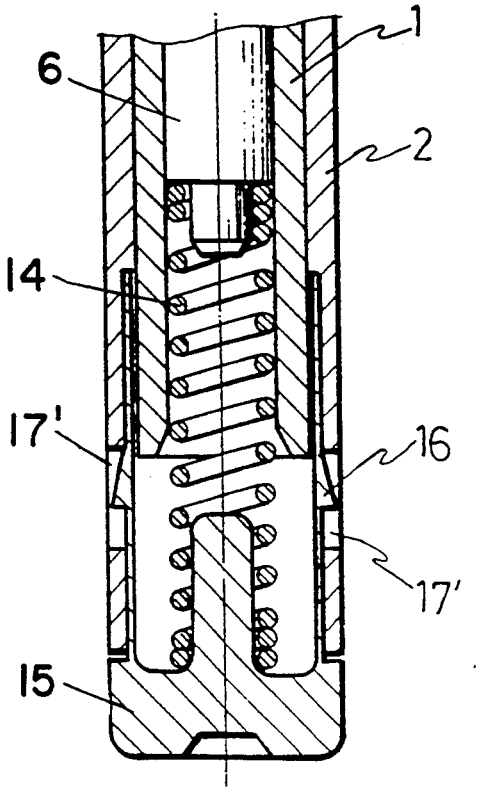
FIG. 24 is a cross sectional view, similar to that shown in FIG. 23, after the pulsing has started.

Comparing FIGS. 23 and 24 respectively corresponding to the rest positions and that of pulsing, it is seen that the telescopic run is carried out firstly in the telescopic set, on pulsing to produce ignition. After this movement, a withdrawal of the telescopic set takes place as occurs in the case described with reference to FIG. 1.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. A piezoelectric mechanism for a gas lighter comprising:

first and second telescopic assemblies;

a first spring for maintaining the telescopic assemblies spaced apart by a predetermined distance;

a piezoelectric element fixedly mounted in one of said telescopic assemblies;

a plexor element movably disposed in the other of said telescopic assemblies and retained in a first position at a spaced distance from the piezoelectric element;

a second spring for biasing the plexor element toward the piezoelectric element;

means for preventing relative rotation between the telescopic assemblies including an angular member having a first portion operatively associated with the first telescopic assembly and a second portion operatively associated with the second telescopic assembly;

means for releasing the plexor element from its first position, said releasing means separately associated with said telescopic assemblies such that the application of a compressive force of sufficient magnitude to cause the first and second assemblies to move toward each other also causes the releasing means to release the plexor element from its first position, so that the second spring can move the plexor element toward the piezoelectric element with sufficient force to generate a spark;

means for releasing gas from the lighter; and means for transmitting the spark to the location where gas is released from the lighter for ignition thereof;

wherein the angular member transmits electrical current when the spark is generated while assisting in the release of gas from the lighter for ignition thereof.

2. The mechanism of claim 1 wherein the first telescopic assembly contains the piezoelectric element mounted between an anvil and a limiting piece which is contacted by the plexor element to generate the spark.

3. The mechanism of claim 1 wherein the second telescopic element includes a pair of elongated notches and slots which guide the movement of the plexor element therein.

4. The mechanism of claim 3 wherein the plexor element has a generally cylindrical body, a tapered front end, a cylindrical stud for engaging the second spring, and a pair of diametrically opposed lugs mounted on the cylindrical body for engaging the notches and slots of the second telescopic assembly.

5. The mechanism of claim 4 wherein the releasing means comprises a first ramp located in each of the elongated notches such that the movement of the telescopic assemblies toward each other causes the plexor element lugs to contact the ramps of the elongated notches, thus rotating the plexor element out of its first position.

6. The mechanism of claim 5 wherein the elongated notches include slots for engaging the plexor element lugs for retaining the plexor element in the first position.

7. The mechanism of claim 6 wherein each of the elongated notches includes a second ramp for directing the plexor element lugs into the respective slots and the first position when the compressive force is removed and the telescopic assemblies return to their spaced apart predetermined distance.

8. The mechanism of claim 4 further comprising a cap member interlockingly engageable with an end of the second telescopic assembly for engaging the second spring and retaining it therein.

9. The mechanism of claim 2 wherein the telescopic assemblies rotation prevention means angular member includes an L-shaped angular piece with the first portion arranged at substantially a right angle with respect to the second portion.

10. The mechanism of claim 9 wherein the first telescopic assembly includes an external notch and the first portion of the L-shaped angular piece includes a pair of lugs forming a central slot for engaging the external notch of the first telescopic assembly.

11. The mechanism of claim 10 wherein at least a portion of the second telescopic assembly has a square cross-sectional configuration, and the second portion of the L-shaped angular piece includes an orthographic flank for engaging one of the sides of the second telescopic assembly.

12. The mechanism of claim 11 wherein the end of the orthographic flank of the second portion of the L-shaped angular piece includes a ramp whose inclination regulates the opening of the gas when being displaced angularly with respect to the gas releasing means.

13. The mechanism of claim 8 further between the second telescopic assembly and the cap member, with the second spring member maintaining the cap member at a predetermined distance from the second telescopic assembly.

14. The mechanism of claim 9 wherein each of the anvil, piezoelectric element, limiting piece and L-shaped angular piece is formed of a conductive material so that an electric current can pass through these components to ignite the gas which is released.

15. The mechanism of claim 10 where the central slot includes means for lockingly engaging the first telescopic assembly to prevent extraction of the L-shaped angular member therefrom.

16. The mechanism of claim 13 wherein the axial displacement means comprises a pair of tab members on the cap member and a pair of windows located in the second telescopic assembly.

17. A piezoelectric mechanism for a gas lighter comprising:

internal and external telescopic assemblies;

a first spring for maintaining the telescopic assemblies spaced apart by a predetermined distance;

a piezoelectric element fixedly mounted in the internal telescopic assembly between an anvil and a limiting piece;

a plexor element movably disposed in the external telescopic assembly and retained in a first position at a spaced distance from the limiting piece;

a second spring for biasing the plexor element toward the limiting piece;

means for preventing relative rotation between the telescopic assemblies including an L-shaped angular piece with a first portion engaging the external telescopic assembly and a second portion engaging the internal telescopic assembly;

means for releasing the plexor element from its first position, said releasing means separately associated with said telescopic assemblies such that the application of a compressive force of sufficient magnitude to cause the internal and external assemblies to move toward each other also causes the releasing means to release the plexor element from its first position, so that the second spring can move the plexor element toward the piezoelectric element with sufficient force to contact the limiting piece to generate a spark;

means for releasing gas from the lighter; and means for transmitting the spark to the location where gas is released from the lighter for ignition thereof;

wherein the external telescopic element includes a pair of elongated notches and slots which guide the movement of the plexor element therein and the plexor element has a generally cylindrical body, a tapered front end, a cylindrical stud for engaging the second spring, and a pair of diametrically opposed lugs mounted on the cylindrical body for engaging the notches and slots of the external telescopic assembly; and wherein the L-shaped angular piece transmits electrical current when the spark is generated while assisting in the release of gas from the lighter for ignition thereof.

18. The mechanism of claim 17 wherein each of the anvil, piezoelectric element, limiting piece and L-shaped angular piece is formed of a conductive metal so that an electric current can pass through these components to ignite the gas which is released.

19. A piezoelectric mechanism for a gas lighter comprising:

internal and external telescopic assemblies;

a first spring for maintaining the telescopic assemblies spaced apart by a predetermined distance;

a piezoelectric element fixedly mounted in the internal telescopic assembly between an anvil and a limiting piece;

a plexor element movably disposed in the external telescopic assembly and retained in a first position at a spaced distance from the limiting piece;

a second spring for biasing the plexor element toward the limiting piece;

means for preventing relative rotation between the telescopic assemblies including an L-shaped angular piece with a first portion engaging the external telescopic assembly and a second portion engaging the internal telescopic assembly;

means for releasing the plexor element from its first position, said releasing means separately associated with said telescopic assemblies such that the application of a compressive force of sufficient magnitude to cause the internal and external assemblies to move toward each other also causes the releasing means to release the plexor element from its first position, so that the second spring can move the plexor element toward the piezoelectric element with sufficient force to contact the limiting piece to generate a spark;

means for transmitting the spark to the location where gas is released from the lighter for ignition thereof;

means for releasing gas from the lighter; and a cap member interlockingly engageable with an end of the second telescopic assembly for engaging the second spring and retaining it therein;

wherein the external telescopic element includes a pair of elongated notches and slots which guide the movement of the plexor element therein and the plexor element has a generally cylindrical body, a tapered front end, a cylindrical stud for engaging the second spring, and a pair of diametrically opposed lugs mounted on the cylindrical body for engaging the notches and slots of the external telescopic assembly; and wherein the L-shaped angular piece transmits electrical current when the spark is generated while assisting in the release of gas from the lighter for ignition thereof.

20. The mechanism of claim 19 further comprising means for providing axial displacement between the external telescopic assembly and the cap member, with the second spring member maintaining the cap member at a predetermined distance from the external telescopic assembly, and wherein the axial displacement means comprises a pair of tab members on the cap member and a pair of windows located in the external telescopic assembly.

* * * * *